United States Patent [19]

Kinouchi et al.

[11] Patent Number: 4,846,307

[45] Date of Patent: Jul. 11, 1989

[54] SEPARATE LUBRICATING SYSTEM OF TWO CYCLE ENGINE

[75] Inventors: Sosuke Kinouchi, Kakogawa; Yukikazu Sumitomo, Akashi, both of Japan

[73] Assignee: Kawasaki Jukogyo Kabushiki Kaisha, Kobe, Japan

[21] Appl. No.: 98,466

[22] Filed: Sep. 18, 1987

[30] Foreign Application Priority Data

Oct. 15, 1986 [JP] Japan ..... 61-157999[U]

[51] Int. Cl.[4] ..... F01M 1/04

[52] U.S. Cl. ..... 184/6.5; 123/196 CP

[58] Field of Search ..... 123/196 R, 196 CP, DIG. 5, 123/73 AD; 184/6.5, 6.6, 6.7, 6.8, 6.9; 440/88

[56] References Cited

U.S. PATENT DOCUMENTS 2,346,148 4/1944 Bosma ..... 184/6.18 X
3,570,465 3/1971 Masaoka ..... 184/6.28 X
3,967,612 7/1976 Yamada ..... 123/196 CP
4,388,896 6/1983 Sheridan et al. ..... 123/73 AD
4,475,488 10/1984 Odashima ..... 184/6.18 X

*Primary Examiner*—Leonard E. Smith
*Attorney, Agent, or Firm*—Wenderoth, Lind & Ponack

[57] ABSTRACT

A separate lubricating system for a two-stroke-cycle outboard engine comprises a sealed oil tank disposed above the engine for storing therein a lubricating oil used in the separate lubricating system. Compressed air from a crankcase of the engine passes through a check valve attached to the crankcase and is introduced into the oil tank by a pipeline. The separate lubricating system is also provided with a plunger pump for forcibly delivering oil supplied from the oil tank under the compressive force of the compressed air to lubricated parts of the engine. The separate lubricating system of the engine can correctly meter the quantity of the lubricating oil even when air is charged into and trapped in the plunger pump.

4 Claims, 4 Drawing Sheets

FORE ⟷ AFT

SEPARATE LUBRICATING SYSTEM OF TWO CYCLE ENGINE

BACKGROUND OF THE INVENTION

The present invention relates to a separate lubricating system best adapted for use in a crankcase compression type lubricating system in a two-stroke-cycle engine (hereinafter referred to as a "two cycle engine") suitable for use in, for instance, an outboard marine engine unit.

In the conventional outboard engine having a separate lubricating system, lubricating oil is supplied from an oil tank with an air breather to a plunger pump driven by the crankshaft of a two cycle engine and is thus forced to flow toward parts of the two cycle engine to be lubricated (hereinafter referred to as "the lubricated parts").

However, when the outboard engine is tilted up, the attitude of the outboard engine greatly changes as a whole, so that air may be swept into and entrapped within the plunger pump. Therefore a problem arises in that the quantity of the lubricating oil delivered from the plunger pump cannot be metered correctly, and consequently the engine cannot be satisfactorily lubricated.

Especially in the case of a plunger pump disposed above the oil tank, once the air has been aspirated into the plunger pump, it becomes more difficult to discharge the entrapped air, so that the above-described problems are further aggravated.

OBJECT OF THE INVENTION

In view of the above described problems, the primary object of the present invention is to provide a separate lubricating system for two cycle engines which can correctly meter the quantity of the lubricating oil even when air is charged into and trapped in a plunger pump.

SUMMARY OF THE INVENTION

In order to accomplish the object stated above, the present invention provides a separate lubricating system for a two cycle engine of the crankcase compression type. An enclosed oil tank stores lubricating oil for the separate lubricating system. A pipe conducts compressed air from a check valve disposed in the crankcase of the two cycle engine into the oil tank. A plunger pump forces the oil supplied from the oil tank to the lubricated parts of the two cycle engine under pressure of the compressed air.

Under the effect of the compressed air from the crankcase, the oil stored in the oil tank is supplied under pressure to the plunger pump. Even if air is swept into and trapped in the plunger pump, the trapped air is forcibly discharged by the pressure of the compressed air, thus allowing the oil delivered from the plunger pump to be correctly metered.

DETAILED DESCRIPTION

Prior to describing the preferred embodiments of the present invention, a conventional separate lubricating system of a two cycle outboard engine will be described briefly with reference to FIG. 5 for a better understanding of the present invention.

Figure 5:
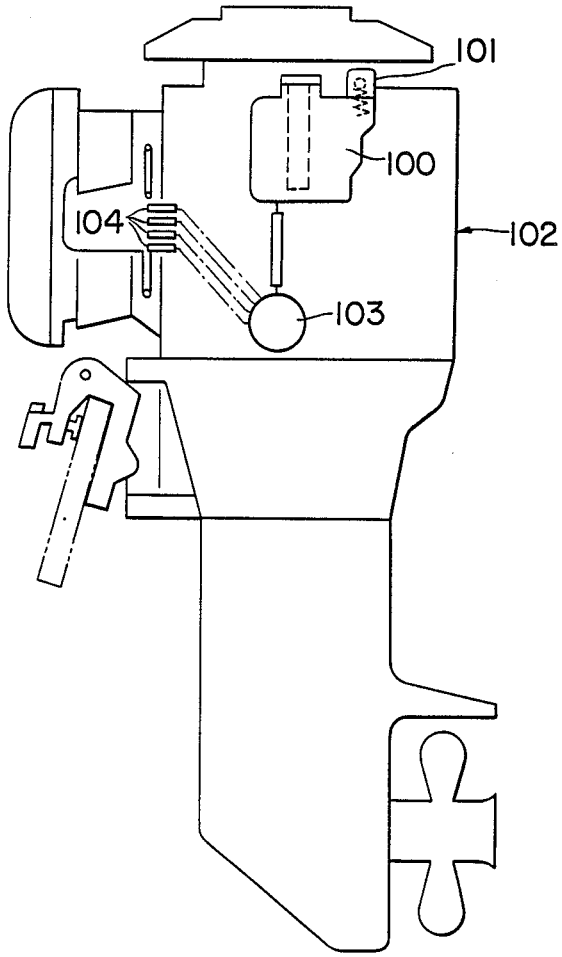
FIG. 5 PRIOR ART
FIG. 5 is a schematic port side elevation illustrating the construction of an outboard engine unit with a prior-art lubricating system.

Referring first to FIG. 5, an outboard engine unit has a two cycle engine 102 with a conventional separate lubricating system having, an air breather valve 101 mounted on an oil tank 100 storing therein a lubricating oil. The oil from the oil tank 100 is supplied to a plunger pump 103 driven by the crankshaft of the two cycle engine 102 and is forced to flow to lubricated parts 104.

Figure 1:
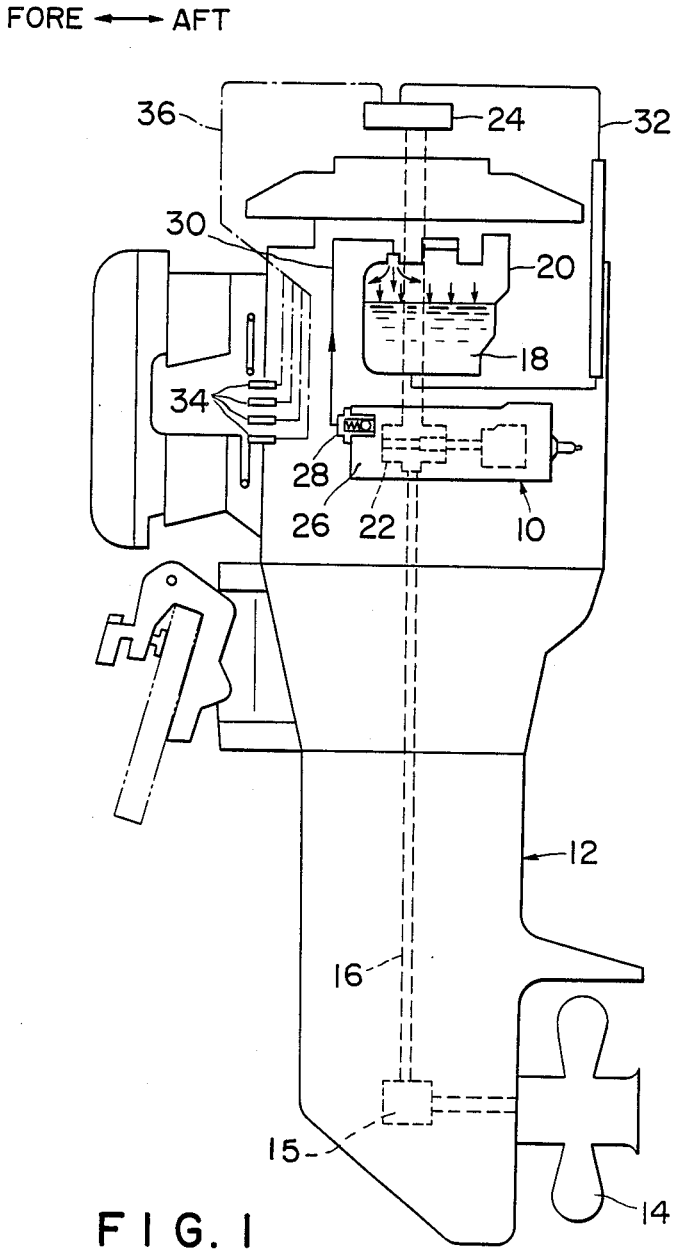
FIG. 1 is a schematic port side elevation illustrating the construction of a first embodiment of the lubricating system in accordance with the present invention in an outboard engine unit.
Figure 2:
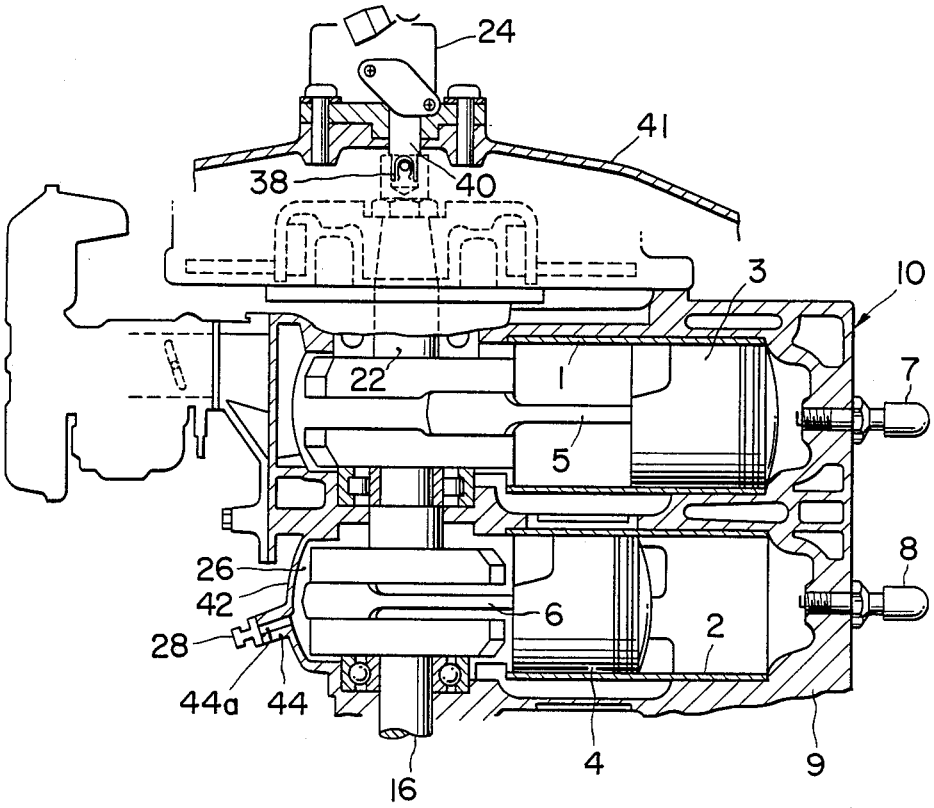
FIG. 2 is a longitudinal sectional view of the two cycle engine in the outboard engine unit.

Referring next to FIGS. 1 and 2 illustrating an outboard engine with a lubricating system in accordance with the present invention, a pressurized crankcase type two cycle engine 10 has two cylinder bores 1 and 2 extending in the horizontal direction, in tandem inline arrangement in the vertical direction. Pistons 3 and 4 are slidably fitted within the cylinder bores 1 and 2, respectively, and are coupled through connecting rods 5 and 6 to a crankshaft 22. Ignition spark plugs 7 and 8 are screwed through a cylinder head 9 of the engine 10. The engine 10 and a lower unit 12 constitute the outboard engine.

The lower unit 12 is provided with a propeller 14, to which the power of the engine 16 is transmitted through a drive shaft 16 and a reduction unit 15.

An oil tank 20 which stored an oil 18 is disposed above the engine 10 and is an enclosed tank made of, for instance, a plastic. A plunger pump 24 is also disposed above the engine 10, and is coupled to the crankshaft 22 of the engine 10, as will be described in more detail below.

A check valve 28, which only permits the passage of a positive pressure in the crankcase chamber 26 of the engine, fitted in the crankcase wall and is communicated through a line 30 with the upper interior portion of the oil tank 20. Compressed air in the crankcase chamber 26 can then be forced to flow through the line 30 into the upper portion of the oil tank 20. Because of the pressure of the compressed air, the oil 18 is pressurized to a pressure of, for instance, approximately 1.2 $kg/cm^2$.

The bottom of the oil tank 20 and the plunger pump 24 are communicated with each other through a line 32, and the plunger pump 24 and the lubricated parts 34 of the engine 10 are communicated with each other through a line 36.

Referring next to FIG. 2, construction and the installation of the check valve 28 and the plunger pump 24 will be described in detail. The upper end of the crankshaft 22 is coupled to the driving shaft 40 of the plunger pump 24 through a joint 38, which is adapted to compensate for the misalignment between the crankshaft 22 and the plunger 40. Reference numeral 41 designates the engine cover. The check valve 28 is fitted in a crankcase 42 and communicates with a passage 44a formed through a projection 44 extending outwardly from the lower left portion of the crankcase 42.

Figure 3:
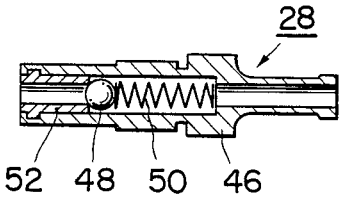
FIG. 3 is a longitudinal sectional view of a check valve.

As best shown in FIG. 3, the check valve 28 comprises a substantially cylindrical main body 46, a ball-shaped valve body 48 and a spring 50. Normally, the ball-shaped valve body 48 is pressed under the force of the spring 50 against a valve seat 52 which is fitted in and fixed to the left end portion of the main body 46, as by clinching.

The mode of operation of the first embodiment of the invention of the above-mentioned construction will now be described. Even when the whole outboard engine as shown in FIG. 1 is tilted upwardly so that the air bubbles are sucked into the plunger pump 24, the oil 18 is pressurized by the pressure of the compressed air due to the fact that the compressed air is introduced from the crankcase 26 through the check valve 28 and the line 32 into the oil tank 20. Therefore, the air bubbles in the oil 18 are collapsed by the compressed air. The trapped air bubbles are charged into the plunger pump with the oil in the suction stroke of the plunger pump. When the plunger chamber is communicated with the surrounding atmosphere during the discharge stroke, the trapped air expands because of the pressure difference, so that some of the trapped air in the oil is discharged out of the plunger. Several of these cycles quickly discharges the trapped air out of the plunger pump. As a result, a necessary and sufficient quantity of the lubricating oil is forced to flow toward the lubricated parts 34 of the engine 10.

Figure 4:
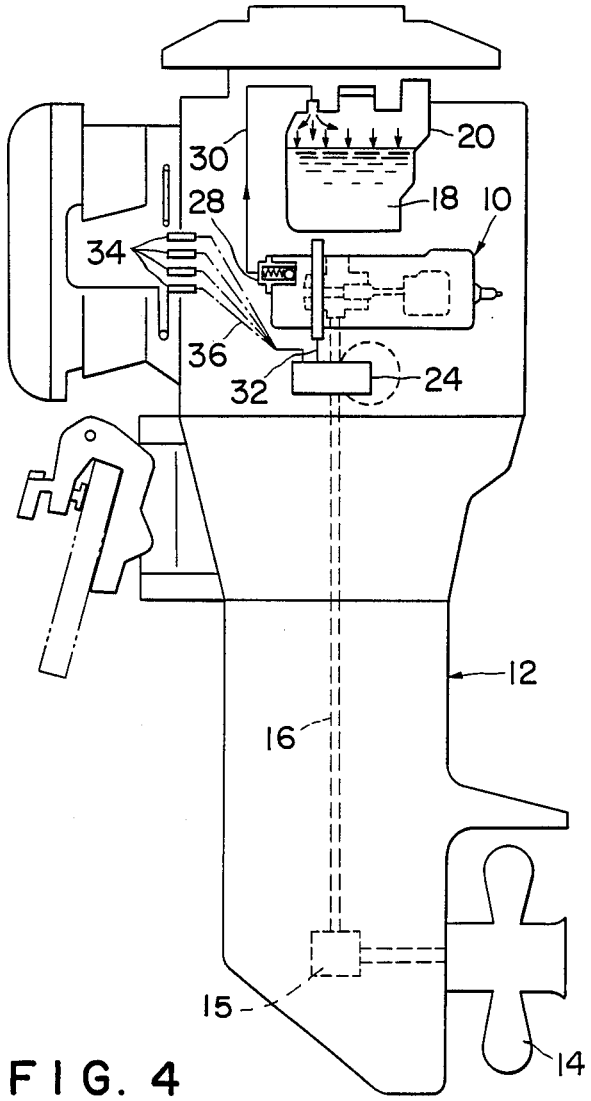
FIG. 4 is a schematic port side elevation illustrating the construction of a second preferred embodiment of the lubricating system of the present invention in an outboard engine unit.

It is to be understood that the scope of the present invention is not limited to the first embodiment described above, but encompasses the situation where the plunger pump 24 is disposed below the engine 10 as shown in FIG. 4.

In the second embodiment of the invention shown in FIG. 4, the air bubbles trapped in the plunger pump 24 tend to flow upwardly into the oil tank 20 disposed above the plunger pump 24 through line 32. But as in the case of the first embodiment described above, the air bubbles are discharged out of the plunger pump 24 so that the quantity of the lubricating oil discharged from the plunger pump 24 can be correctly controlled.

As described above, in the separate lubricating system of two cycle engines in accordance with the present invention, the compressed air is forced to flow through the check valve 28 into the oil tank. Therefore even if the plunger pump 24 sucks in air bubbles, they can be collapsed under the pressure of the compressed air so that the quantity of the lubricating oil discharged from the plunger pump 24 can be correctly metered. As a result, oil delivery of the plunger pump 24 can be accurately and positively maintained, and the correct quantity of the oil can be supplied to the lubricated parts 34 of the engine 10.

It is to be understood that the scope of the present invention is not limited to the first and second embodiments described above with reference to FIGS. 1 to 4, but may encompass other crankcase compression type two cycle engines, such as motorcycle engines.

What is claimed is:

1. A separate lubricating system in a two-stroke-cycle engine wherein the crankcase of said engine produces compressed air during operation, comprising:

a sealed oil tank disposed above said engine for storing therein a lubricating oil;

a check valve attached to said crankcase;

a pipeline means for introducing compressed air from said crankcase into said oil tank via said check valve; and a plunger pump for receiving said lubricating oil from said oil tank under force of said compressed air and for delivering said lubricating oil to parts of said engine requiring lubrication.

2. A separate lubricating system as set forth in claim 1, wherein:

said pipeline means is a pipe directly connecting said check valve and said sealed oil tank.

3. A separate lubricating system as set forth in claim 1, wherein:

said plunger pump is disposed above said engine.

4. A separate lubricating system as set forth in claim 1, wherein:

said plunger pump is disposed below said engine.

* * * * *